US006182848B1

(12) United States Patent
Wang

(10) Patent No.: US 6,182,848 B1
(45) Date of Patent: Feb. 6, 2001

(54) LUMINAIRE HOUSING WITH UNIVERSAL DUAL SURFACE CANTILEVER HINGE

(75) Inventor: James P. Wang, Blacksburg, VA (US)

(73) Assignee: Hubbell Incorporated, Orange, CT (US)

( * ) Notice: Under 35 U.S.C. 154(b), the term of this patent shall be extended for 0 days.

(21) Appl. No.: 09/500,531

(22) Filed: Feb. 9, 2000

(51) Int. Cl.[7] ..... B65D 7/00

(52) U.S. Cl. ..... 220/4.22; 220/4.2; 220/841; 16/266

(58) Field of Search ..... 220/4.2, 4.22, 220/841; 16/266

(56) References Cited

U.S. PATENT DOCUMENTS

| | | | | |
|---|---|---|---|---|
| D. 375,379 | | 11/1996 | DiCola et al. . | |
| 2,302,661 | * | 11/1942 | Benson | 220/841 X |
| 2,533,661 | * | 12/1950 | Arenberg et al. | 220/841 X |
| 2,559,009 | * | 7/1951 | Coyle et al. | 220/841 |
| 3,425,587 | * | 2/1969 | Duross, Jr. | 220/4.22 X |
| 4,099,648 | * | 7/1978 | Kirkton | 220/841 |
| 4,308,972 | | 1/1982 | McReynolds et al. . | |
| 4,345,697 | | 8/1982 | Wilson et al. . | |
| 5,141,123 | * | 8/1992 | Onodera | 220/4.2 |

OTHER PUBLICATIONS

LSI Industries Inc. Scottsdale Superkit Catalog, p. 8; 1998.
Sketch of LSI Industries Inc. Scottsdale Superkit Hinge.
Advertisement for LSI Industries Inc. Scottsdale Superkit.

* cited by examiner

*Primary Examiner*—Steven Pollard
(74) *Attorney, Agent, or Firm*—Alfred N. Goodman; Mark S. Bicks; Tara L. Hoffman

(57) ABSTRACT

A luminaire housing includes a frame having a securing member, a door panel movable between open and closed positions relative to the frame, and a hinge member. The hinge member pivotally connects the door panel and the securing member and includes a fixed end portion, a first angled ramp portion, a second angled ramp portion, and a centering portion. The fixed end portion is attached to the door panel and the first angled ramp portion extends from it. The fixed end portion includes an open hinge surface. The second angled ramp portion extends from the first angled portion and the centering end portion extends from the second angled ramp portion, forming a closed hinge surface between them. The open hinge surface of the first hinge member is in contact with the securing member of the frame when the door panel is in the open position. The closed hinge surface is in contact with the securing member when the door panel is in the closed position allowing the first hinge member to be in continuous contact with the securing member when the door panel is moved between the open and closed positions.

34 Claims, 4 Drawing Sheets

LUMINAIRE HOUSING WITH UNIVERSAL DUAL SURFACE CANTILEVER HINGE

FIELD OF THE INVENTION

The present invention generally relates to a lighting unit, such as a luminaire. The lighting unit has a host housing including a frame and a door panel with hinge members releasably coupling the frame and door panel. Each hinge member includes a fixed end portion, a first angled ramp portion, a second angled ramp portion, and a centering end portion which provide continuous engagement with the frame and facilitate movement of the door panel between open and closed positions.

BACKGROUND OF THE INVENTION

A luminaire is a lighting unit commonly installed on a ceiling. Usually luminaire housings are formed of a host housing unit and a pivotally attached door with a lighting assembly mounted onto the door. New doors are often retro-fit to conform to existing housing units. A hinge is employed to couple the door to the housing unit for the door to pivot between open and closed positions.

Prior art host housing units commonly include a interior flange for sealing and engaging a door and coupling the door to the housing unit by a hinge member. The flange is inserted in between the door and the hinge. The hinge itself is attached to the door panel at one end and pivotally connected to the housing flange at its opposing end.

For the retro-fit door of a luminaire housing to move smoothly and precisely between open and closed positions, the door must be positioned appropriately with respect to the flange and the housing unit, and the door must not obstruct the flange itself. Prior art hinges neglect to provide a way of easily positioning the door to fit appropriately with the housing unit. As a result, the burden is on the operator to couple the door with the housing unit to ensure that the door is properly positioned.

In addition, the prior art hinges do not prevent the door from obstructing and/or damaging the flange. Specifically, if the door is hung to close to the rear flange of the housing unit, the door panel will obstruct and bend the flange downwardly upon attempting to close the door.

Examples of prior art hinges employed with a housing and door are disclosed in U.S. Pat. Nos.: 4,345,697 to Wilson et al.; and 4,308,972 to McReynolds et al.

SUMMARY OF THE INVENTION

Accordingly, an object of the present invention is to provide a luminaire housing that provides a frame, a door that can be retro-fitted on an existing housing, and a hinge member releasably coupling the frame and door.

Another object of the present invention is to provide a luminaire housing that includes a hinge attached to the door that remains in continuous contact with the frame of the housing upon opening and closing the door.

A further object of the present invention is to provide a luminaire housing having a hinge with a centering end portion that facilitates easy positioning of the door with the frame of the housing.

Yet another object of the present invention is to provide a luminaire housing that includes a hinge with a clear-out area that allows the door to open and close smoothly without obstructing the flange of the frame.

The foregoing objects are basically attained by a luminaire housing comprising a frame having a securing member, a door panel movable between open and closed positions relative to the frame, and a first hinge member. The first hinge member pivotally connects the door panel and the securing member and includes a fixed end portion, a first angled ramp portion, a second angled ramp portion, and a centering portion. The fixed end portion is attached to the door panel and the first angled ramp portion extends therefrom. The fixed end portion further includes an open hinge surface. The second angled ramp portion extends from the first angled portion and the centering end portion extends from the second angled ramp portion, forming a closed hinge surface therebetween. The open hinge surface of the first hinge member is in contact with the securing member of the frame when the door panel is in the open position. The closed hinge surface is in contact with the securing member when the door panel is in the closed position allowing the first hinge member to be in continuous contact with the securing member when the door panel is moved between the open and closed positions.

By designing the hinge member in this fashion, it can be used with various size doors that are retro-fit to accommodate existing housing units.

Other objects, advantages and salient features of the invention will become apparent from the following detailed description, which taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
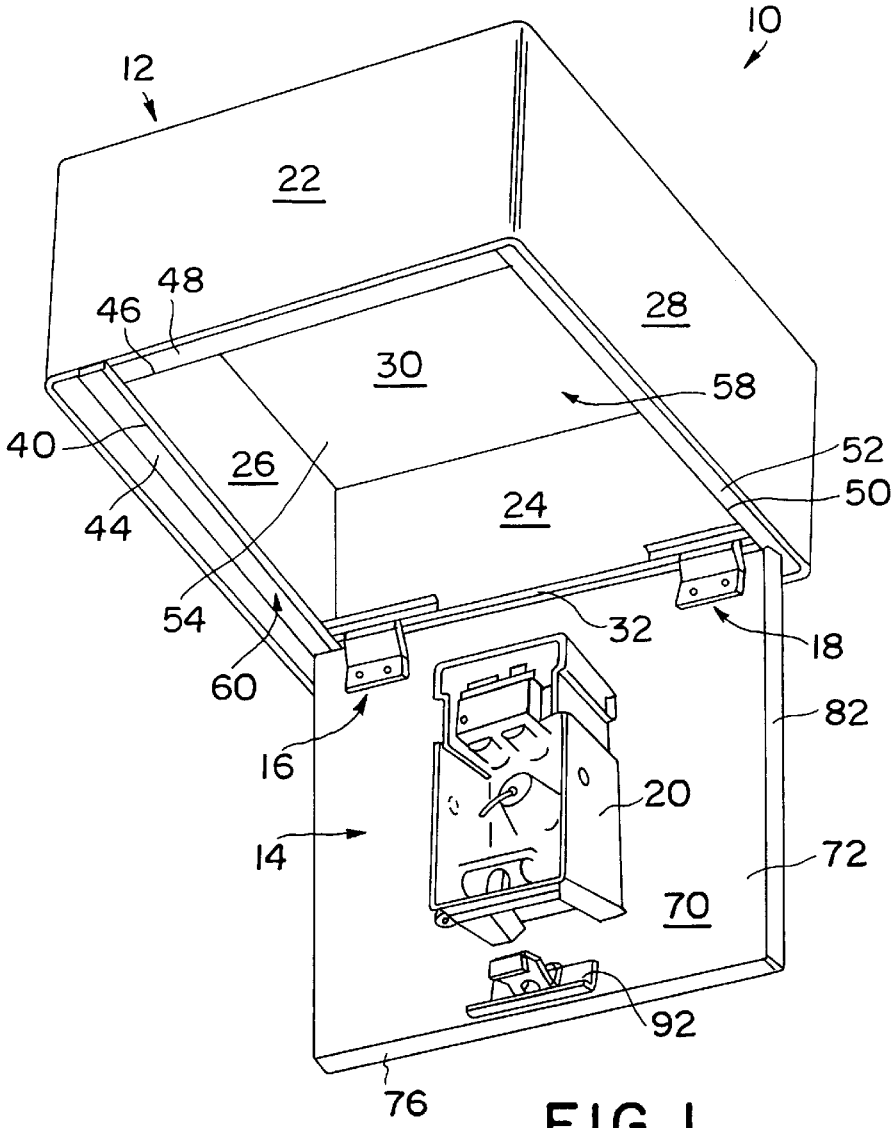
FIG. 1 is a bottom right side perspective view of a luminaire housing with a lighting assembly according to an embodiment of the present invention, illustrating the retro-fit door coupled to the host housing in its open position.
Figure 2:
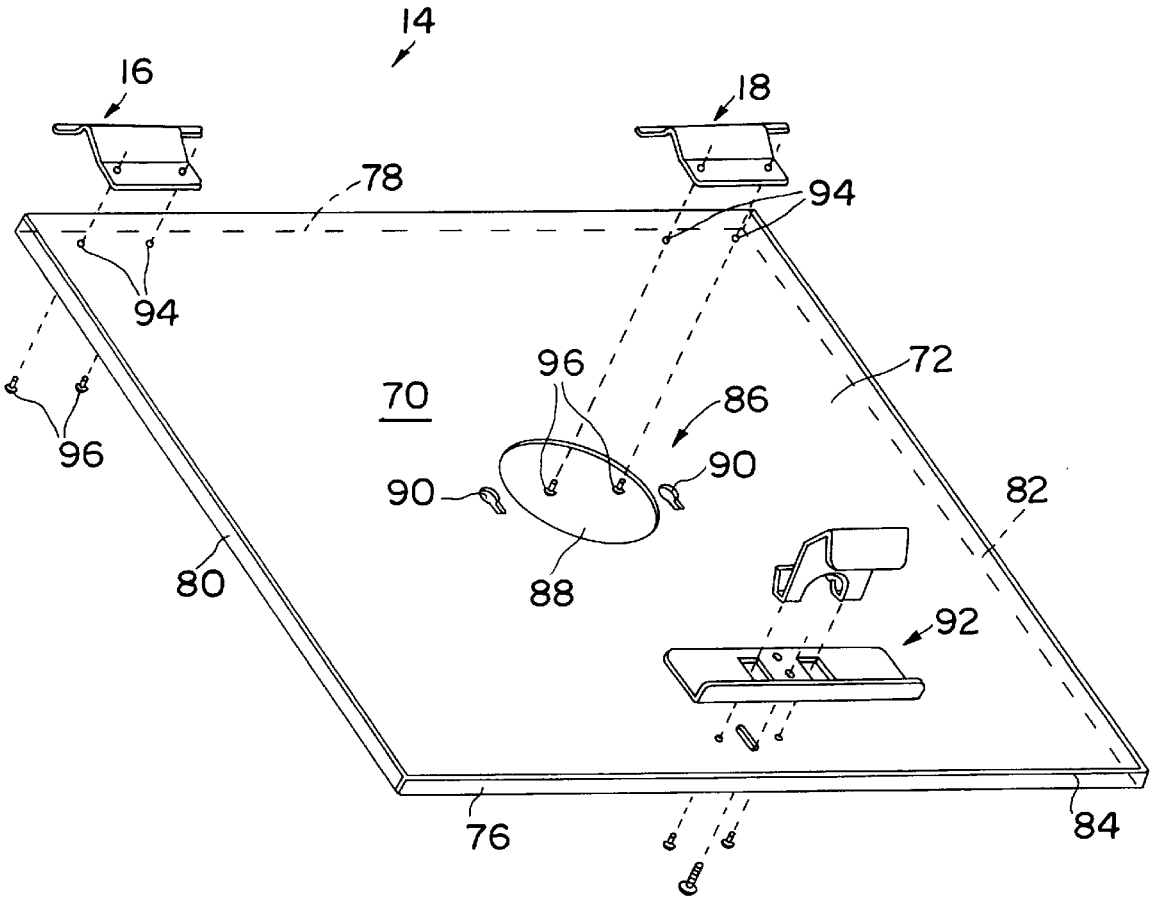
FIG. 2 is an exploded, perspective view of the door and hinge members illustrated in FIG. 1.

Referring to FIGS. 1–2, luminaire housing 10 includes a frame 12, a retro-fit door panel 14, and first and second hinge members 16 and 18. Hinge members 16 and 18 are attached to door panel 14 and releasably couple frame 12 and door panel 14, allowing door panel 14 to move between open and closed positions. Lighting assembly 20 is mounted on door panel 14 such that upon closing door panel 14, lighting assembly 20 is fully enclosed within frame 12. Preferably, frame 12, door panel 14, and hinge members 16 and 18 are all formed of a metallic material. However, any suitable type of rigid material, such as plastic, can be used to form these components.

As seen in FIG. 1, frame 12 comprises a front wall 22, a rear wall 24, a left sidewall 26, a right sidewall 28, and a top wall 30. Front wall 22 is connected to left sidewall 26 at one end and right sidewall 28 at the opposing end, and is disposed opposite rear wall 24. Similarly, rear wall 24 is connected to left sidewall 26 at one end and right sidewall 28 at the opposing end, and is disposed opposite front wall 22. Front and rear walls 22, 24 and left and right sidewalls 26, 28 are all substantially planar and rectangular and extend downwardly from substantially planar top wall 30 such that each of the planes of front and rear walls 22, 24 and left and right sidewalls 26, 28 are substantially perpendicular to the plane of top side wall 30.

Each of front and rear wall 22, 24 and left and right sidewalls 26, 28 are of substantially equal length and depth forming a substantially square shaped frame with an open bottom. However, frame 12 can be of any of polygonal, circular or curved shape. In addition, although walls 22, 24, 26, 28, and 30 are preferably unitarily formed, they can be integrally connected by an attachments such as an adhesive, fasteners or the like.

Frame 14 also has securing members comprising four inwardly extending flanges angularly oriented with respect to one another. As seen in FIG. 1, first or rear flange 32 extends inwardly from rear wall 24; second or left flange 40 extends inwardly from left sidewall 26; third or front flange 46 extends inwardly from front wall 22; and fourth or right flange 50 extends inwardly from right sidewall 28. The flanges are preferably unitarily formed with frame 12, but can be formed separately and attached.

Rear or first flange 32 includes a substantially planar top surface 34, bottom surface 36, and front surface 38 as seen in FIGS. 1 and 5–7. Similarly, left flange 40 is substantially planar with top and bottom surfaces 42 and 44. The front and right flanges 46, 50 are also substantially planar with bottom surfaces 48 and 52, respectively. The space between the inner perimeter surface 54 of frame 12 and the top surfaces of flanges 32, 40, 46, and 50 forms an upper receiving area 58 for receiving lighting assembly 20. Similarly, the space between the inner perimeter surface 54 and the bottom surfaces of flanges 32, 40, 46, and 50 forms lower receiving, area 60 for receiving door panel 14.

Referring to FIGS. 1–2, and 5–7, door panel 14 is hingedly and pivotally attached to frame 12 by hinge members 16 and 18, discussed further below. Door panel 14 comprises a planar body 70 with an upper surface 72 and a lower surface 74. Extending downwardly from the sides of planar body 70, respectively, are front shoulder 76, rear shoulder 78, left shoulder 80, and right shoulder 82 forming a substantially square outer surface 84. Upon closing door panel 14, lighting assembly 20 is enclosed in upper receiving area 58. In addition, door panel 14 is received in lower receiving area 60 such that upper surface 72 of door panel 14 is adjacent but spaced from the bottom surfaces of each of rear, left, front, and right flanges 32, 40, 46, and 50 of frame 12. Also, outer surface 84 of the front, rear, left, and right shoulders of door panel 14 is proximate but spaced from inner perimeter surface of frame front and rear walls 22, 24, and frame left and right sidewalls 26, 28, respectively.

Although planar body 70 is preferably square in shape, it can be of any polygonal or circular shape that can be accommodated by lower receiving area 60 of frame 12. In addition, it is preferable that shoulders 76, 78, 80, and 82 are unitarily formed on planar body 70, but may be separably formed and integrally connected such as by an adhesive means or the like. However, it will be understood that door panel 14 can be oriented in any manner so long as outer surface 84 of door panel 14 fits within lower receiving area 60 of frame 12.

Lighting assembly 20 is removably mounted to upper surface 72 of door panel 14 by mounting 86, as seen in FIGS. 1 and 2. Mounting 86 is centrally located on planar body 70 and includes a mounting aperture 88 and key holes 90. Key holes 90 are substantially smaller than mounting aperture 88 and receive mounting bolts (not shown) of lighting assembly 20. A portion of lighting assembly 20 is then received in mounting aperture 88. Although at least two key holes 90 are preferred, only one key hole 90 is required to mount light assembly 20.

Door panel 14 further includes latch assembly 92 disposed opposite hinge members 16 and 18 for locking and unlocking door panel 14 relative to frame 12, as seen in FIGS. 1 and 2. Latch assembly 92 is fully disclosed in concurrently filed U.S. patent application Ser. No. 09,500, 526 of James Wang entitled Latch Assembly For Luminaire Housing Door, the subject matter of which is hereby incorporated by reference.

Referring to FIGS. 1–7, first and second hinge members 16 and 18 are fixed to upper surface 72 of door panel 14, and are pivotally connected to rear, left, and right flanges 32, 40, and 50 of frame 12. Specifically, hinge members 16 and 18 are spaced from one another on door panel 14 and each engages rear flange 32 of frame 12. In addition, first hinge member 16 simultaneously engages left flange 40 and second hinge member 18 simultaneously engages right flange 50. Such engagement releasably couples frame 12 and door panel 14, while preventing door panel 14 from disengaging frame 12. The hinge members can engage either the front, rear, left, or right flanges of frame 12 as long as at least two flanges are simultaneously engaged and door panel 14 fits properly within lower receiving area 60.

First and second hinge members 16 and 18 are substantially identical and as such only details of first hinge member 16 will be described. In general, hinge member 16 includes a fixed end portion 100, a first angled ramp portion 108, a second angled ramp portion 114, and centering end portion 122.

Fixed end portion 100 has a substantially planar front surface 102 and rear surface 104. Rivet or screw holes 106 are disposed on fixed end portion 100 that correspond to rivet or screw holes 94 in door panel 14. Hinge member 16 is attached to door panel 14 by inserting fasteners 96, such as screws, through holes 94 of door panel 14 and holes 106 of fixed end portion 100. Although at least two screw holes and fasteners are preferable, only one screw hole and fastener are required to effectively secure hinge member 16 to door panel 14.

First angled ramp portion 108, second angled ramp portion 114, and centering end portion 122 all have substantially planar front surfaces 110, 116, 124, and rear surfaces 112, 118, and 126, respectively. First angled ramp portion 108 angularly extends from fixed end portion 100 such that their front surfaces 102 and 110 form an obtuse angle therebetween. Similarly, second angled ramp portion 114 extends at an angle from first angled ramp portion 108 such that their rear surfaces 112 and 118 form an obtuse angle. Likewise, centering end portion 122 angularly extends from second angled ramp portion 114 such that their front surfaces 116 and 124 form an obtuse angle. As a result, the planes of first angled ramp portion 108 and centering end portion 122 are substantially parallel, with second angled ramp 114 portion extending therebetween.

Figure 3:
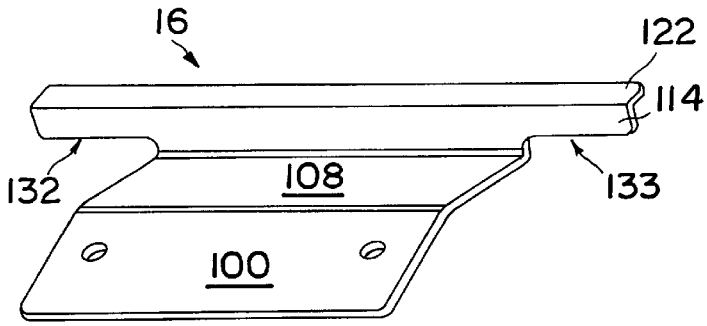
FIG. 3 is a rear perspective view of one of the hinge members of the luminaire housing of FIG. 1, illustrating the open and closed hinge surfaces.
Figure 4:
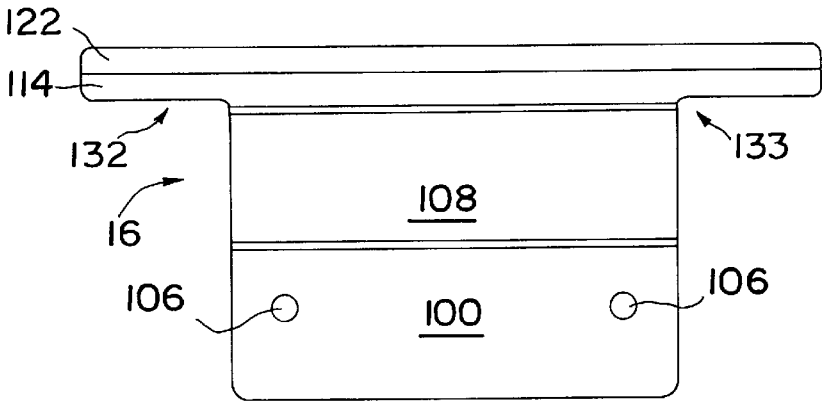
FIG. 4 is a rear elevational view of one of the hinge members of the luminaire housing of FIG. 1, illustrating the open and closed hinge surfaces.

In addition, the width and height of fixed end portion 100 and first angled ramp portion 108 are substantially equal, as are the widths and heights of second angled ramp portion 114 and centering end portion 122. Also, the width of the fixed end portion 100 and first angled ramp portion 108 is less than the width of second angled ramp portion 114 and centering end portion 122. In contrast, the height of the fixed end portion 100 and first angled ramp portion 108 is greater than the width of second angled ramp portion 114 and centering end portion 122. An overall T-shape with second angled ramp portion 114 and centering end portion 122 forming left and right outwardly extending arms 132 and 133 results, as seen in FIGS. 3 and 4.

As seen in FIGS. 3–7, second angled ramp portion 114 also includes an open hinge surface 120 on its rear surface 118. The open hinge surface 120 contacts rear and left flanges 32 and 40 of frame 12 upon opening door panel 14. Similarly, a closed hinge surface 128 is located between rear surfaces 118 and 126 of second angled ramp portion 114 and centering end portion 122. Closed hinge surface 128 contacts rear and left flanges 32 and 40 when door panel 14 is closed. Open and closed hinge surfaces 120 and 128 allow hinge member 16 to be in continuous contact with rear and left flanges 32 and 40.

Preferably hinge member 16 is a one-piece unitary member. However, fixed end portion 100, first angled ramp portion 108, second angled ramp portion 114, and centering end portion 122 can be formed separately and connected by any known attachment means. Also, two hinge members are preferably employed to couple door panel 14 and frame 12, one hinge member can be used by increasing the width of the hinge member such that left and right arms 132, 133 engage left and right flanges 40 and 50, respectively.

Figure 5:
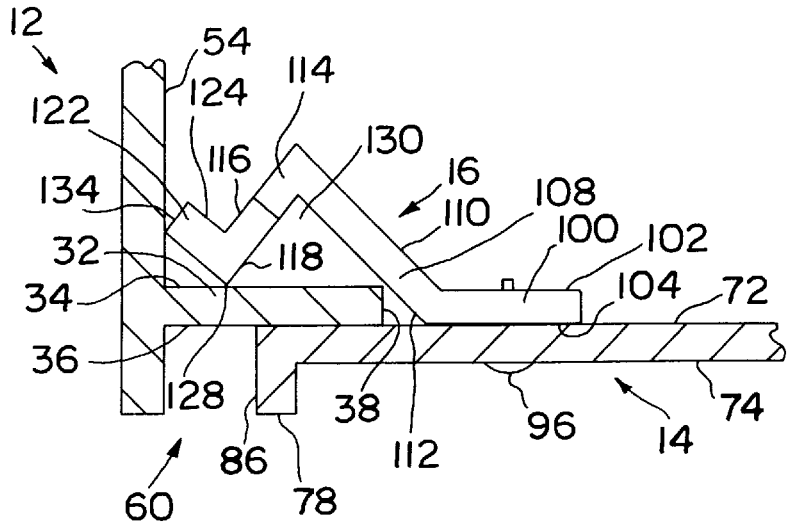
FIG. 5 is an enlarged, partial side elevational view in section of the luminaire housing of FIG. 1, illustrating the hinge member engaged with the rear flange of the frame and the door panel in the closed position.
Figure 6:
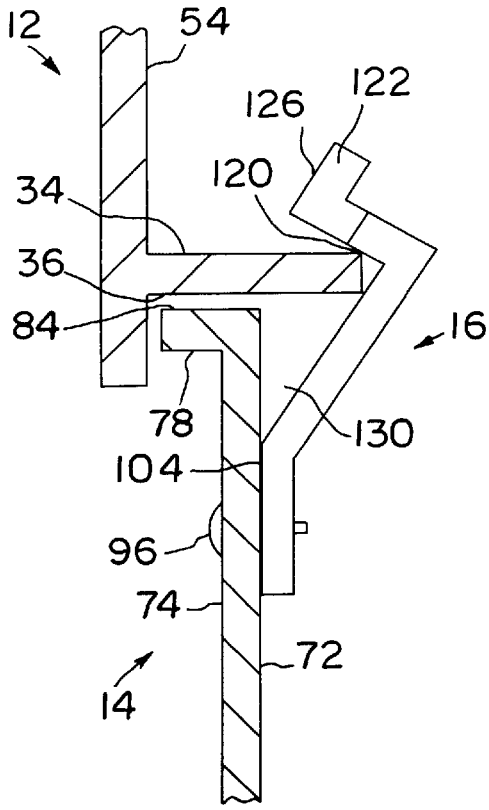
FIG. 6 is an enlarged, partial side elevational view in section of the luminaire housing of FIG. 1, illustrating the hinge member engaged with the rear flange of the frame, and the door panel in the open position.

FIGS. 5 and 6 illustrate door panel 14 and hinge member 16 in a closed position and an open position, respectively. Installing door panel 14 onto frame 12 requires two steps. First, door panel 14 in its open position is inserted at an angled to form the position illustrated in FIG. 1 about a vertical axis into the interior of frame 12 such that left arm 132 of hinge member 16 clears left flange 40 and right arm 133 of hinge member 18 clears right flange 50. Second, door panel 14 is rotated about a vertical axis to its open position and coupled to rear and left flanges 32 and 40. By inserting the flanges into a clear-out area 130 between hinge member 16 and door panel 14, the door panel is coupled with the flanges. Clear-out area 130 is defined between upper surface 72 of door panel 14 and rear surfaces 112 and 118 of first and second angled ramp portions 108 and 114 of hinge member 16. Clear-out area 130 is of sufficient size to allow the flanges of frame 12 to be easily inserted therein. In addition, clear-out-area 130 allows for a smooth transition when moving door panel 14 between open and closed positions thus preventing damage to the flanges of frame 12. Preferably, clear-out area 130 is wedged shaped or has a triangular cross-section but it can be of various shapes as long as the flanges of frame 12 are easily accommodated.

In addition, centering end portion 122 of hinge member 16 includes a centering surface 134 that positions door panel 14 and hinge member 16 on rear and left flanges 32 and 40 of frame 12. Upon insertion of rear and left flanges 32 and 40 into clear-out area 130, centering surface 134 abuts inner surface 54 of rear wall 24 such that door panel 14 and hinge member 16 are properly positioned on flanges 32 and 40 of frame 12. Thus, the burden is removed from the operator attempting to insert the flanges 32 and 40 into clear-out area 130 to correctly position door panel 14 and hinge member 16 with respect to frame 12.

FIG. 5 illustrates hinge member 16 engaging rear flange 32 of frame 12 when door panel 14 is in the closed position. As discussed above, upon closing door panel 14, closed hinge surface 128 of hinge member 16 engages top surface 34 of rear flange 32. When in the closed position, the plane of door panel 14 is substantially parallel to the plane of rear flange 32 such that its upper surface 72 abuts bottom surface 36 of rear flange 32. In addition, outer surface 84 of rear shoulder 78 of door panel 16 is proximate but space from inner perimeter 54 of rear wall 24. Also, centering surface 134 of hinge member 16 abuts rear wall 24 of frame 12 to position door panel 14 and hinge member 16 properly, and front end 38 of rear flange 32 abuts rear surface 112 of first angled ramp portion 108 upon insertion of the flange 32 into clear-out area 130.

FIG. 6 illustrates hinge member 16 engaging rear flange 32 of frame 12 when door panel 14 is in the open position. Upon moving door panel 14 to the open position, clear-out area 130 allows door panel 14 and hinge member 16 to pivot downwardly with respect to rear flange 32. The positioning of hinge member 16 on flange 32 in the clear-out area 130 prevents damage to flange 32 and allows for a smooth transition upon moving door panel 14 to the open position by providing adequate space for the flange to pass through.

In addition, as discussed above, open hinge surface 120 engages front end 38 of rear flange 32 such that hinge member 16 remains in continuous contact with flange 32 upon opening door panel 14 allowing for a smooth transition and preventing damage to the flange. Once in the open position, the plane of door panel 14 is substantially perpendicular to the plane of flange 32 with outer surface 84 of door panel 14 being proximate but spaced from bottom surface 36 of rear flange 32.

Figure 7:
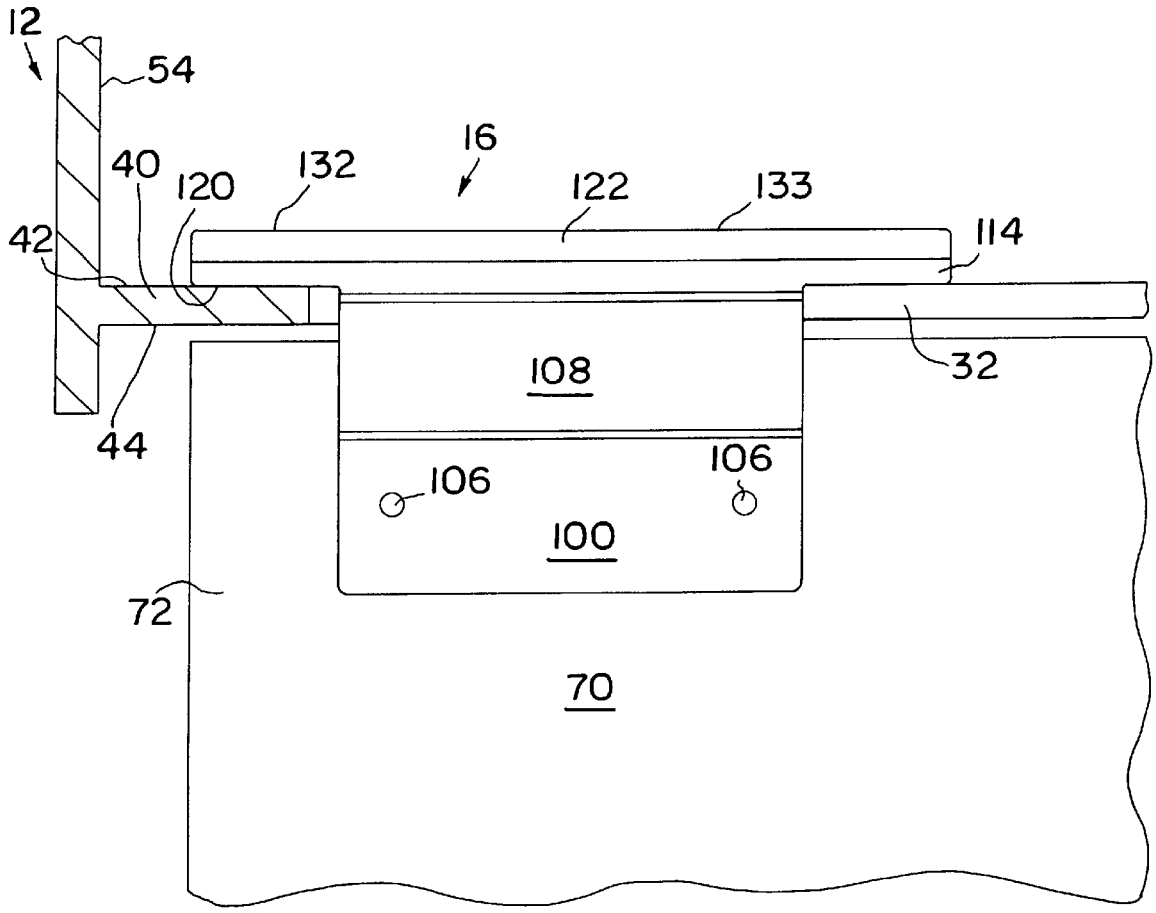
FIG. 7 is a partial front elevational view in section of the luminaire housing of FIG. 1 illustrating the front of the hinge member engaged with the left flange of the frame and the door panel in the open position.

FIG. 7 illustrates hinge member 16 engaging left flange 40 and rear flange 32 when door panel 14 is in the open position. Open hinge surface 120 of hinge member 16 concurrently engages top surfaces 34 and 42 of rear and left flanges 32 and 40. Specifically, the left outwardly extending arm 132 of hinge member 16 engages left flange 40. It should be understood that the right outwardly extending arm 133 of hinge member 18 similarly engages right flange 50 of frame 12. Since hinge member 16 engages both left flange 40 and rear flange 32, door panel 14 is prevented from disengaging from frame 12.

To subsequently move door panel 14 back into the closed position, the steps described with respect to FIGS. 5–7 are reversed. Specifically, door panel 14 is simply pivoted upwardly until it is received in lower receiving area 60 (FIG. 1) of frame 12. Clear-out area 130 provides for a smooth transition upon moving door panel 14, as described above. Closed hinge surface 128 re-engages the rear and left flanges 32 and 40 of frame 12 and upper surface 72 of door panel 14 is brought into abutment with bottom surfaces 36 and 44.

While a particular embodiment has been chosen to illustrate the invention, it will be understood by those skilled in the art that various changes and modifications can be made therein without departing from the scope of the invention as defined in the appended claims.

What is claimed is:

1. A luminaire housing, comprising:

a frame having a securing member;

a door panel movable between open and closed positions relative to said frame; and a first hinge member pivotally connecting said door panel and said securing member of said frame, said first hinge member including, a fixed end portion attached to said door panel, a first angled ramp portion extending from said fixed end portion, a second angled ramp portion extending from said first angled portion and having an open hinge surface, and a centering end portion extending from said second angled ramp portion, said centering end portion and said second angled ramp portion forming a closed hinge surface therebetween;

said open hinge surface of said first hinge member being in contact with said securing member of said frame when said door panel is in the open position, and said closed hinge surface being in contact with said securing member when said door panel is in the closed position allowing said first hinge member to be in continuous contact with said securing member when said door panel is moved between the open and closed positions.

2. A luminaire housing according to claim 1 wherein when said door panel is in said open position, said securing member and said door panel are substantially perpendicular and spaced from one another.

3. A luminaire housing according to claim 1 wherein when said door panel is in said closed position, said securing member and said door panel are substantially parallel, and said door panel abuts said securing member.

4. A luminaire housing according to claim 1 wherein said securing member is an inwardly extending first flange with a top and bottom surface.

5. A luminaire housing according to claim 4 wherein when said door panel is in said closed position, said closed binge surface of said first hinge member abuts said top surface of said first flange, said open hinge surface of said first hinge member is spaced from said top surface, and said door panel abuts said bottom surface of said first flange.

6. A luminaire housing according to claim 4 wherein when said door panel is in said open position, said open hinge surface of said first hinge member abuts said top surface of said first flange and said closed hinge surface of said first hinge member is spaced from said top surface, and said door panel is spaced from said first flange.

7. A luminaire housing according to claim 4 wherein said securing member comprises a second flange; and said first hinge member is pivotally connected to said first flange and to said second flange.

8. A luminaire housing according to claim 7 wherein said first flange is angularly oriented with respect to said second flange.

9. A luminaire housing according to claim 4 wherein said first and second angled ramp portions define a clear-out area preventing damage to said first flange when moving said door panel between said open and closed positions and facilitating easy insertion of said first flange between said door panel and said first hinge member.

10. A luminaire housing according to claim 9 wherein said clear-out area is substantially triangular in cross-section.

11. A luminaire housing according to claim 1 wherein said fixed end portion is substantially planar.

12. A luminaire housing according to claim 1 wherein said first angled ramp portion is substantially planar.

13. A luminaire housing according to claim 1 wherein said second angled ramp portion is substantially planar.

14. A luminaire housing according to claim 1 wherein said centering end portion is substantially planar.

15. A luminaire housing according to claim 14 wherein said centering end portion has a centering surface that abuts said frame upon inserting said securing member between said door panel and said first hinge member allowing proper positioning of said door panel with respect to said frame.

16. A luminaire housing according to claim 1 wherein said first hinge member is a one-piece unitary member.

17. A luminaire housing according to claim 1 wherein a second hinge member is attached to said door panel spaced from said first hinge member and engaging said securing member, said first and second hinge members being substantially identical.

18. A luminaire housing, comprising:

a frame having first and second securing members;

a door panel movable between open and closed positions relative to said frame; and a first hinge member pivotally connecting said door panel and said first and second securing members of said frame, said first hinge member including, a fixed end portion attached to said door panel, a first angled ramp portion extending from said fixed end portion, a second angled ramp portion extending from said first angled portion and having an open hinge surface, and a centering end portion extending from said second angled ramp portion, said centering end portion and said second angled ramp portion forming a closed hinge surface therebetween;

said open hinge surface of said first hinge member being in contact with said first and second securing members of said frame when said door panel is in the open position, and said closed hinge surface being in contact with said first and second securing members when said door panel is in the closed position, allowing said first hinge member to be in continuous contact with said frame when said door panel is moved between the open and closed positions.

19. A luminaire housing according to claim 18 wherein when said door panel is in said open position, said first securing member and said door panel are substantially perpendicular and spaced from one another.

20. A luminaire housing according to claim 18 wherein when said door panel is in said closed position, said first securing member and said door panel are substantially parallel and said door panel abuts said securing member.

21. A luminaire housing according to claim 18 wherein said first and second securing members are first and second inwardly extending flanges each with top and bottom surfaces, respectively.

22. A luminaire housing according to claim 21 wherein said first and second flanges are angularly oriented with respect to one another.

23. A luminaire housing according to claim 21 wherein when said door panel is in said closed position, said closed hinge surface of said first hinge member abuts said top surface of said first and second flanges, said open hinge surface of said first hinge member is spaced from said top surfaces, and said door panel abuts said bottom surface of said first and second flanges.

24. A luminaire housing according to claim 21 wherein when said door panel is in said open position, said open hinge surface of said first hinge member abuts said top surface of said first and second flanges and said closed hinge surface of said first hinge member is spaced from said top surfaces, and said door panel is spaced from said first and second flanges.

25. A luminaire housing according to claim 18 wherein a second hinge member is attached to said door panel spaced from said first hinge member and engaging said securing member, said first and second hinge members being substantially identical.

26. A luminaire housing, comprising:

a frame having opposing rear and front walls and two opposing sidewalls connecting said rear and front walls, said opposing rear and front walls having first and third inwardly extending flanges, respectively, said opposing sidewalls having second and fourth inwardly extending flanges, respectively, each said first, second, third, and fourth flanges having top and bottom surfaces;

a door panel movable between open and closed positions relative to said frame, said door panel having a planar body with a front shoulder, a rear shoulder, and two side shoulders extending downwardly from said planar body; and a first hinge member attached to said door panel proximate said rear shoulder and pivotally connected to said first and second flanges of said frame, said first hinge member having, a fixed end portion attached to said door panel, a first angled ramp portion extending from said fixed end portion, a second angled ramp portion extending from said first angled portion and having an open hinge surface, and a centering end portion extending from said second angled ramp portion, said centering end portion and said second angled ramp portion forming a closed hinge surface therebetween, a plane of said first angled ramp portion being substantially parallel to a plane of said centering end portion and a plane of said second angled ramp portion being substantially perpendicular to the plane of said first angled ramp portion and said centering end portion;

when said door panel is in said open position, said open hinge surface of said first hinge member being in contact with said top surface of said first and second flanges, said closed hinge surface being spaced from said top surfaces, said door panel being substantial perpendicular to said first flange with said rear shoulder of said door panel being spaced from said first flange; and when said door panel is in said closed position, said closed hinge surface being in contact with said top surface of said first and second flanges, said open hinge surface being spaced from said top surfaces, and said door panel being substantially parallel to said first flange with a top surface of said door panel abutting said bottom surface of said first flange.

27. A luminaire housing according to claim 26 wherein said first, second, third, and fourth flanges are rear, left, front, and right flanges, respectively.

28. A luminaire housing according to claim 27 wherein said rear and left flanges are angularly oriented with respect to one another, and said front and right flanges are angularly oriented with respect to one another.

29. A luminaire housing according to claim 26 wherein a second hinge member is attached to said door panel spaced from said first hinge member and engaging said securing member, said first and second hinge members being substantially identical.

30. A luminaire housing according to claim 26 wherein said fixed end portion and said first angled ramp portion have a first length and said second angled ramp portion and said centering end portion have a second length, said first length being greater than said second length.

31. A luminaire housing according to claim 30 wherein said fixed end portion and said first angled ramp portion have a first width and said second angled ramp portion and said centering end portion have a second width, said first width being smaller than said second width.

32. A luminaire housing according to claim 26 wherein said fixed end portion is attached to said door panel by a fastener.

33. A luminaire housing according to claim 32 wherein said fastener is a screw.

34. A luminaire housing according to claim 26 wherein said fixed end portion is attached to said door panel by a plurality of fasteners.

* * * * *